US012232550B1

(12) United States Patent
Morris

(10) Patent No.: US 12,232,550 B1
(45) Date of Patent: Feb. 25, 2025

(54) FOOT AND KNEE PROTECTOR AND METHOD OF USE

(71) Applicant: Mark Morris, Keller, TX (US)

(72) Inventor: Mark Morris, Keller, TX (US)

( * ) Notice: Subject to any disclaimer, the term of this patent is extended or adjusted under 35 U.S.C. 154(b) by 169 days.

(21) Appl. No.: 17/864,164

(22) Filed: Jul. 13, 2022

Related U.S. Application Data

(63) Continuation-in-part of application No. 16/258,649, filed on Jan. 27, 2019, now abandoned.

(60) Provisional application No. 62/622,894, filed on Jan. 27, 2018.

(51) Int. Cl.
*A41D 13/00* (2006.01)
*A41D 13/06* (2006.01)

(52) U.S. Cl.
CPC ..... *A41D 13/065* (2013.01)

(58) Field of Classification Search
CPC ..... A41D 13/065
See application file for complete search history.

(56) References Cited

U.S. PATENT DOCUMENTS 2,448,427 A * 8/1948 Gordon ..... A47C 16/04 182/230
2,484,494 A * 10/1949 Ferguson ..... A41D 13/0568 2/24
2,627,301 A * 2/1953 Emmett ..... E04F 21/24 297/423.11
3,112,812 A * 12/1963 Ramon ..... A41D 13/065 2/24
4,346,784 A * 8/1982 Hammond ..... E04F 21/161 2/24
4,346,848 A * 8/1982 Malcolm ..... B05B 1/02 239/596
4,598,927 A * 7/1986 Monreal ..... A63C 11/00 280/611
4,676,521 A * 6/1987 Monreal ..... A63C 9/00 280/607
4,747,470 A * 5/1988 Fernandez ..... A47C 9/027 2/24
4,772,071 A * 9/1988 Richards ..... A47C 16/04 2/24
4,789,046 A * 12/1988 McDowall ..... E04F 21/24 2/24
5,125,479 A * 6/1992 Nemes ..... A47C 16/04 2/24
5,662,594 A * 9/1997 Rosenblatt ..... A61F 5/013 2/2.5
5,725,224 A * 3/1998 Kerr ..... A63C 17/0026 280/11.19
6,216,819 B1 * 4/2001 Cougar ..... E04D 15/00 182/230

(Continued)

*Primary Examiner* — Richale L Quinn
(74) *Attorney, Agent, or Firm* — Richard Eldredge; Leavitt Eldredge Law Firm

(57) ABSTRACT

A foot and knee protector device includes a support extending from a first end to a second end; a knee pad attached to the support and having one or more straps to secure around a leg of a user; a foot support attached to the support and having one or more straps to secure around a foot of the user; and a toe protector attached to the support via an extension, the toe protector extending past an end of the user's foot; the knee pad and the toe protector protect the user when in a kneeling position, the toe protector preventing the end of the user's foot or boot from coming into contact with a ground surface.

1 Claim, 4 Drawing Sheets

(56) References Cited

U.S. PATENT DOCUMENTS

| | | | | |
|---|---|---|---|---|
| 6,347,404 | B1 * | 2/2002 | Iskra | A47L 13/62 2/24 |
| D454,668 | S * | 3/2002 | Marasco | D29/121.1 |
| D455,237 | S * | 4/2002 | Marasco | D29/121.1 |
| D456,100 | S * | 4/2002 | Marasco | D29/121.1 |
| D462,811 | S * | 9/2002 | Marasco | D29/121.1 |
| D463,072 | S * | 9/2002 | Munoz | D29/121.1 |
| 6,851,124 | B2 * | 2/2005 | Munoz | A41D 13/0568 2/24 |
| 7,152,919 | B2 * | 12/2006 | Wurzelbacher | A47C 16/04 297/423.11 |
| 8,752,214 | B1 * | 6/2014 | Maldonado | A41D 13/0568 2/24 |
| 9,364,047 | B2 * | 6/2016 | Fackler | A43C 15/02 |
| 10,441,007 | B2 * | 10/2019 | Richards | A41D 13/065 |
| 10,661,150 | B1 * | 5/2020 | Simpson | A63C 17/04 |
| 2007/0250977 | A1 * | 11/2007 | Brown | A41D 13/0543 2/22 |
| 2008/0295213 | A1 * | 12/2008 | McDaniel | A41D 13/065 2/24 |
| 2011/0094001 | A1 * | 4/2011 | Maldonado | A41D 13/065 2/24 |
| 2024/0016242 | A1 * | 1/2024 | Garcia | A41D 13/065 |

* cited by examiner

FOOT AND KNEE PROTECTOR AND METHOD OF USE

BACKGROUND

1. Field of the Invention

The present invention relates generally to knee pads, and more specifically, to a protector device for protecting a toe portion of a shoe and a user's knee while kneeling down, such as for working on various machinery and/or devices.

2. Description of Related Art

Knee pads are well known in the art and are effective means to protect a user's knee while kneeling for work, such as is a common practice for mechanical and labor work. One of the problems commonly associated with kneeling, is the damage and pain caused to a user. The user's knee and toe portion of their shoe is unprotected when they kneel down, this can result in pain to the knee and damage and discomfort to the user's shoe and toes. Conventional knee pads provide no benefit to the user's shoe, and therefore it is desirable to create a protector device that protects both the user's knee and shoe.

Accordingly, although great strides have been made in the area of knee pads, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
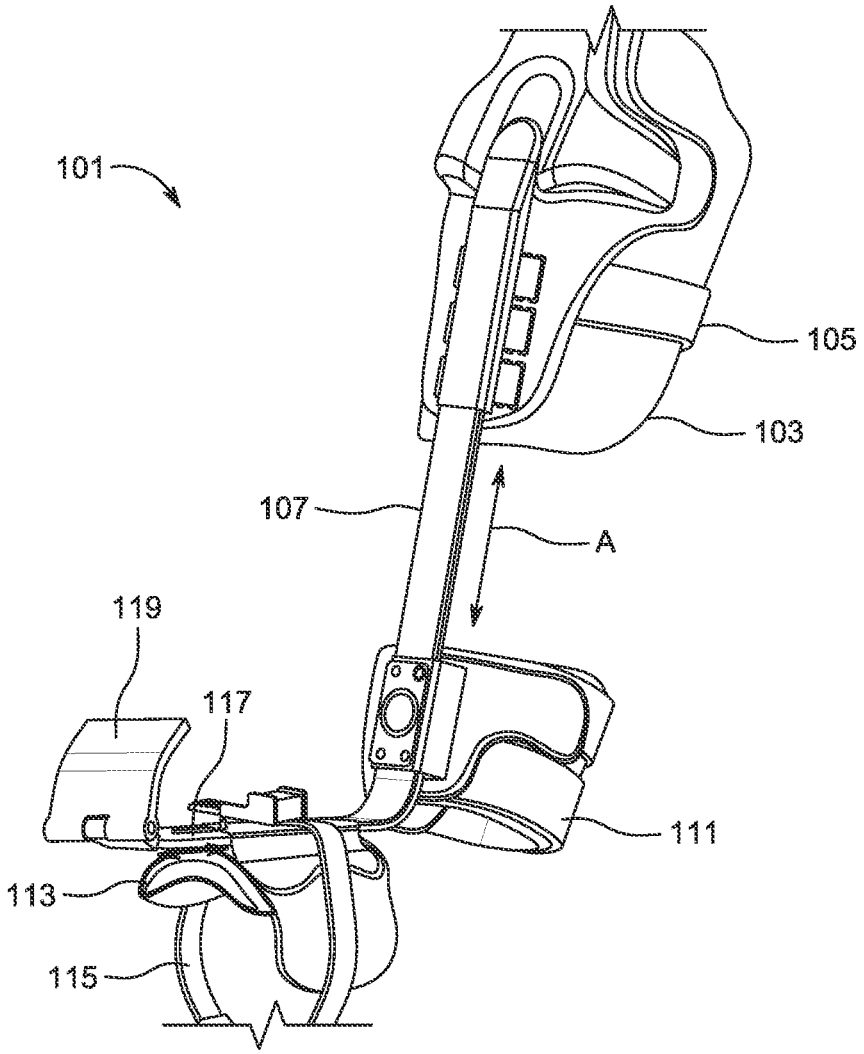
FIG. 1 is a side isometric view of a protector device in accordance with a preferred embodiment of the present application.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional knee pads. Specifically, the present invention provides a means to protect both the user's knee and toe from pain and damage during work while in a kneeling down position. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIG. 1 depicts a side view of a protector device 101 in accordance with a preferred embodiment of the present application. It will be appreciated that device 101 overcomes one or more or the above-listed problems commonly associated with conventional knee pads.

In the contemplated embodiment, device 101 includes a knee pad 103 with one or more straps 105 to secure around a knee of a user. The knee pad is further attached to a support 107 which is slidingly adjustable as shown with arrow A, thereby allowing for the device 101 to fit users of various heights. Also attached to the support 107 is an ankle strap 111 which may be padded and further is adjustable relative to the knee pad via support 107.

As further shown, the device 101 includes a foot support 113 which includes one or more straps 115 to extend around the foot of the user, thereby providing a means for the foot support to secure to a boot or other shoe. The foot support 113 may be rigid and rigidly attached to support 107. An extension 117 extends from foot support 113 to a toe protector 119. The toe protector in the preferred embodiment is rigid and provides for a gap between the user's toes and a ground surface when in use (See FIG. 3). Again, it must be appreciated that extension 117 is slidingly adjustable in length, as shown with arrow B, to provide for an adjustable fit of device 101.

Figure 2:
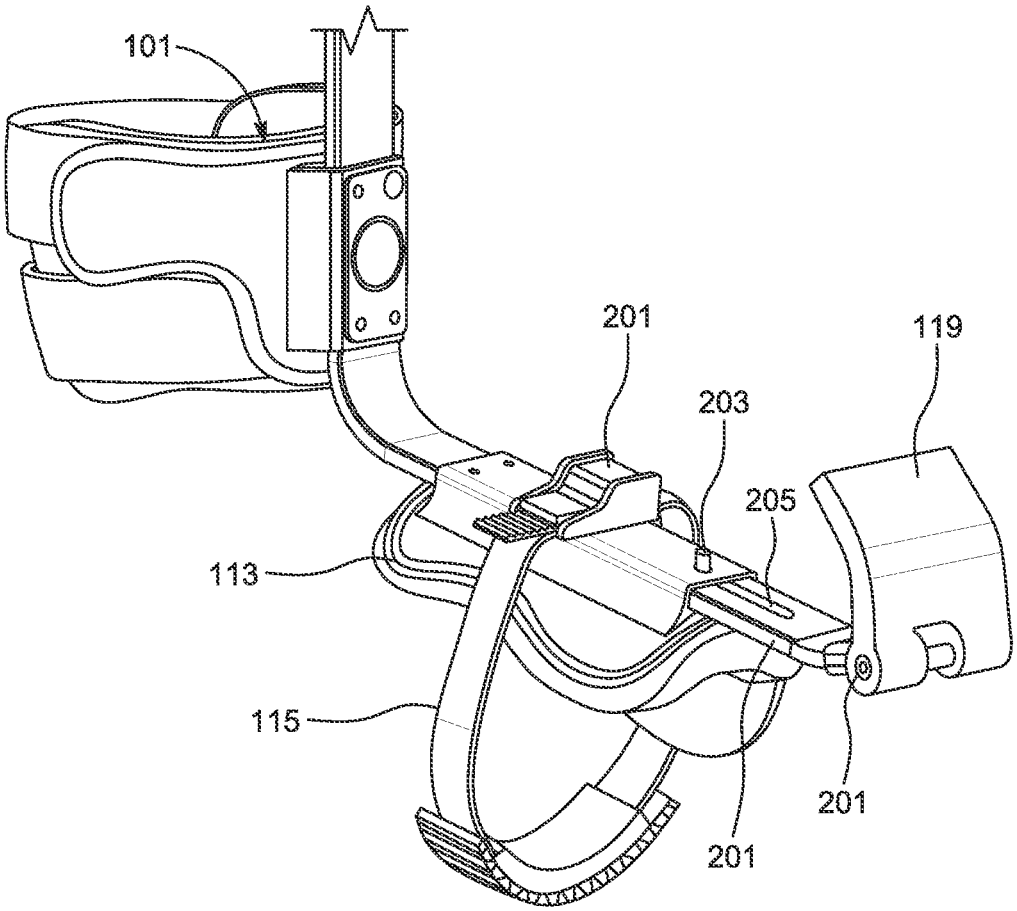
FIG. 2 is a front isometric view of the protector device of FIG. 1.

In FIG. 2, the toe protector 119 is shown attached to extension 117 via a connector 201. In some embodiments, it is contemplated that the connector 201 may be a pivot connection to allow for the toe protector to pivot. Further shown in FIG. 2, is a button 203 and channel 205 configuration, which provides the means for the extension 117 to be adjusted in length. Strap 115 includes an adjustor 207 to provide for adjustment of the strap.

Figure 3:
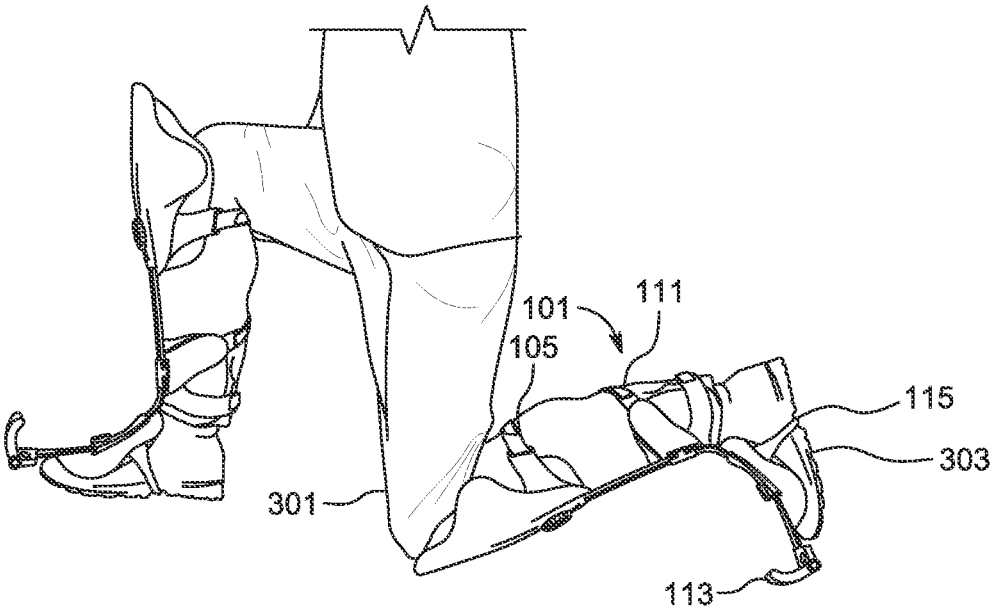
FIG. 3 is a side view of the protector device of FIG. 1 in use.

In FIG. 3, device 101 is shown in use with a user. As shown, the user will utilize the one or more straps to secure the device 101 around the user's leg 301 and foot 303. The toe protector 119 will extend past the end of the user's foot/boot, thereby holding the user's toe up and off of a ground surface when in use.

It should be appreciated that device 101 can include various materials, including aluminum, neoprene, foam, or any other suitable material as would be understood by those skilled in the art.

It should be appreciated that one of the unique features believed characteristic of the present application is toe support, being attached to an extension and extending a distance past the toe of the user. It should be understood that this feature allows for the user to protect their knee from pain and damage, as well as protect their shoe from becoming damaged while kneeling down to work, such as during mechanical work or gardening.

Figure 4:
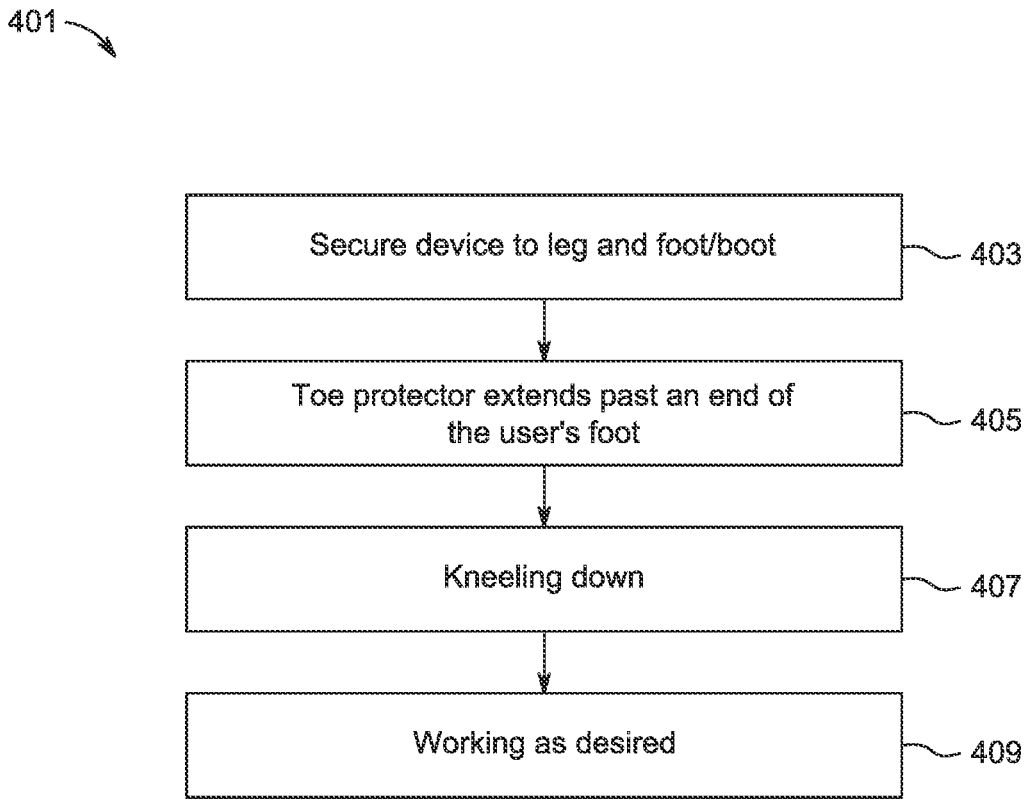
FIG. 4 is a flowchart of the method o fuse of the protector device of FIG. 1.

In FIG. 4, a flowchart 401 depicts a method of use of device 101. During use, the user adjusts sizing of the device and secures the device to their leg and foot/boot, as shown with box 403. The toe protector of the device extending out past the end of the user's foot, as shown with box 405. As desired, the user can kneel down with the protector device preventing the user's toe and knee from coming into contact with the ground surface and work, as shown with boxes 407, 409.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A foot and knee protector device comprising:

a support extending from a first end to a second end;

a knee pad attached to the first end and having one or more straps to secure around a leg of a user;

a foot support attached to the second end and having one or more straps to secure around a foot of the user, wherein the support is adjustable in length such that a space is increased and decreased between the knee pad the foot support; and a toe protector attached to the support via an extension, the toe protector extending past an end of the user's foot, the toe protector is pivotally attached to the second end and slidingly engages with the support such that the toe protector is moved relative to the foot support;

wherein the knee pad and the toe protector protect the user when in a kneeling position, the toe protector preventing the end of the user's foot or boot from coming into contact with a ground surface.

* * * * *